US008754580B2

(12) United States Patent
Abe et al.

(10) Patent No.: US 8,754,580 B2
(45) Date of Patent: Jun. 17, 2014

(54) SEMICONDUCTOR APPARATUS AND METHOD OF CONTROLLING OPERATION THEREOF

(75) Inventors: Hirohisa Abe, Osaka (JP); Cheng Hong, Shanghai (CN)

(73) Assignee: Ricoh Company, Ltd., Tokyo (JP)

( * ) Notice: Subject to any disclaimer, the term of this patent is extended or adjusted under 35 U.S.C. 154(b) by 147 days.

(21) Appl. No.: 13/256,502

(22) PCT Filed: Jan. 13, 2010

(86) PCT No.: PCT/JP2010/000129

§ 371 (c)(1),
(2), (4) Date: Sep. 14, 2011

(87) PCT Pub. No.: WO2010/106723

PCT Pub. Date: Sep. 23, 2010

(65) Prior Publication Data

US 2012/0001551 A1 Jan. 5, 2012

(30) Foreign Application Priority Data

Mar. 17, 2009 (JP) ..... 2009-064448

(51) Int. Cl.
*H05B 37/00* (2006.01)

(52) U.S. Cl.
USPC ..... 315/127; 315/291; 315/294; 315/297; 315/312; 327/332; 327/331

(58) Field of Classification Search
USPC ..... 315/291, 307, 285, 284, 127, 294, 297, 315/312, 308; 327/332, 331, 306
See application file for complete search history.

(56) References Cited

U.S. PATENT DOCUMENTS 5,010,306 A * 4/1991 Kutzavitch et al. ..... 330/284
5,844,378 A * 12/1998 LoCascio et al. ..... 315/307
2002/0047634 A1* 4/2002 Ito et al. ..... 315/291

(Continued)

FOREIGN PATENT DOCUMENTS

JP 5-335853 12/1993
JP 7-170726 7/1995

(Continued)

OTHER PUBLICATIONS

International Search Report and Written Opinion in PCT/JP2010/000129.

(Continued)

*Primary Examiner* — Douglas W Owens
*Assistant Examiner* — Jonathan Cooper
(74) *Attorney, Agent, or Firm* — Cooper & Dunham LLP

(57) ABSTRACT

A semiconductor apparatus includes an input terminal to which an input voltage is applied; an output terminal at which an output voltage is obtained; a power supply circuit unit configured to generate the output voltage from the input voltage, the output voltage having a value corresponding to a duty cycle of a voltage setting signal that is externally applied to the semiconductor apparatus; and a determination circuit unit determining whether the voltage setting signal has a predetermined signal level for the duration of a first predetermined time or longer. The determination circuit unit activates the power supply circuit unit when the voltage setting signal does not have the predetermined signal level for the duration of the first predetermined time or longer. The power supply circuit unit is deactivated when the voltage setting signal has the predetermined signal level for the duration of the first predetermined time or longer.

11 Claims, 7 Drawing Sheets

(56) References Cited

U.S. PATENT DOCUMENTS

| | | | | |
|---|---|---|---|---|
| 2002/0047641 | A1* | 4/2002 | Ito et al. | 315/307 |
| 2004/0174149 | A1 | 9/2004 | Agari et al. | |
| 2007/0114986 | A1 | 5/2007 | Yoshii | |
| 2007/0159151 | A1* | 7/2007 | Katoh et al. | 323/285 |
| 2008/0150505 | A1 | 6/2008 | Abe | |
| 2009/0303641 | A1 | 12/2009 | Abe | |
| 2010/0237833 | A1 | 9/2010 | Abe | |

FOREIGN PATENT DOCUMENTS

| | | |
|---|---|---|
| JP | 2006-101663 | 4/2006 |
| JP | 2006-158038 | 6/2006 |
| JP | 2006-311646 | 11/2006 |
| JP | 2007-288851 | 11/2007 |
| JP | 2007-317239 | 12/2007 |
| JP | 2008-154419 | 7/2008 |
| JP | 2008-306788 | 12/2008 |
| JP | 2009-22092 | 1/2009 |
| JP | 2009-22093 | 1/2009 |
| JP | 2009-33883 | 2/2009 |
| JP | 2009-55708 | 3/2009 |
| JP | 2009-225521 | 10/2009 |
| JP | 2010-141982 | 6/2010 |

OTHER PUBLICATIONS

Chinese official action dated Feb. 27, 2014 (including English-language translation) in corresponding Chinese patent application No. 2010 80 01 2439.6.

* cited by examiner

SEMICONDUCTOR APPARATUS AND METHOD OF CONTROLLING OPERATION THEREOF

TECHNICAL FIELD

The present invention relates to semiconductor apparatuses having a power supply circuit whose output voltage is varied depending on the duty cycle of a voltage setting signal.

BACKGROUND ART

In a semiconductor apparatus with a built-in power supply circuit for LEDs used as a backlight of an LCD panel of a cellular phone, for example, the size of IC packaging should be minimized in order to reduce the size of the apparatus. Thus, it is important to reduce the number of terminals used in an IC package. In one method, the number of such terminals may be reduced by assigning multiple functions to a single IC terminal.

For example, in a conventional semiconductor apparatus, a clock signal is supplied to a triangular wave oscillating circuit via a clock signal input terminal, which is an external terminal of the semiconductor apparatus, to generate a triangular wave voltage used for the PWM (pulse wave modulation) control of a switching regulator (see Japanese Laid-Open Patent Application No. 2006-101663, for example). The clock signal is also supplied to a clock pulse detection circuit. The clock pulse detection circuit generates a standby signal if the clock signal remains at a low level for a certain duration of time, thereby terminating the operation of the switching regulator. Thus, the clock signal input terminal doubles as a standby signal input terminal of the switching regulator. However, such a system cannot be utilized when the clock signal of the triangular wave oscillating circuit is generated within the semiconductor apparatus.

Thus, there is a need for a semiconductor apparatus including a power supply circuit, such as a switching regulator, having a reduced number of terminals, wherein a clock signal of a triangular wave oscillating circuit is generated within the semiconductor apparatus. There is also a need for a method of controlling an operation of such a semiconductor apparatus.

In one aspect of the present invention, a semiconductor apparatus includes an input terminal to which an input voltage is applied; an output terminal at which an output voltage is obtained; a power supply circuit unit configured to generate the output voltage from the input voltage, the output voltage having a value corresponding to a duty cycle of a voltage setting signal that is externally applied to the semiconductor apparatus; and a determination circuit unit configured to determine whether the voltage setting signal has a predetermined signal level for the duration of a first predetermined time or longer. The determination circuit unit, when it determines that the voltage setting signal does not have the predetermined signal level for the duration of the first predetermined time or longer, activates the power supply circuit unit, and deactivates the power supply circuit unit when it determines that the voltage setting signal has the predetermined signal level for the duration of the first predetermined time or longer.

In another aspect of the present invention, a method of controlling an operation of a semiconductor apparatus includes generating an output voltage at an output terminal of the semiconductor apparatus from an input voltage applied to an input terminal of the semiconductor apparatus, the output voltage having a value corresponding to a duty cycle of a voltage setting signal externally applied to the semiconductor apparatus; determining whether the voltage setting signal has a predetermined signal level for the duration of a first predetermined time or longer; supplying the output voltage to the output terminal of the semiconductor apparatus when the determining step determines that the voltage setting signal does not have the predetermined signal level for the duration of the first predetermined time or longer; and not supplying the output voltage to the output terminal when the determining step determines that the voltage setting signal has the predetermined signal level for the duration of the first predetermined time or longer.

BRIEF DESCRIPTION OF THE DRAWINGS

Other objects, features and advantages of the present invention will become apparent upon consideration of the specification and the appendant drawings, in which.

DETAILED DESCRIPTION OF THE PREFERRED EMBODIMENTS

Figure 1:
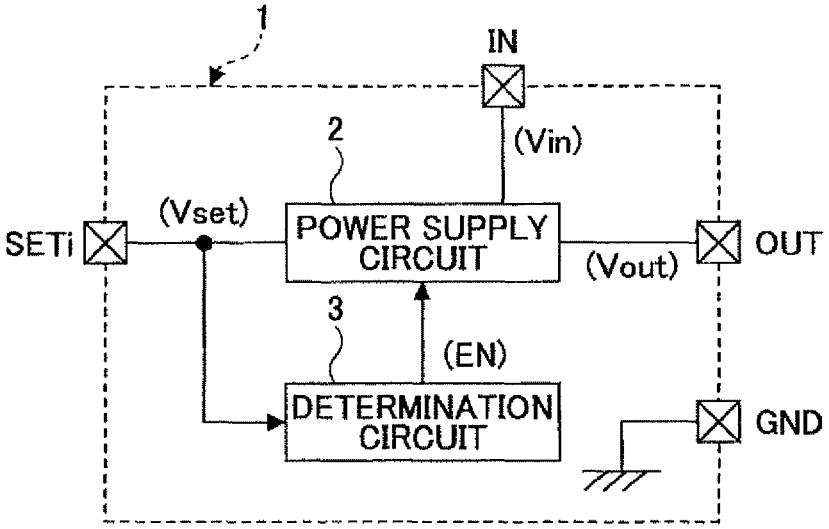
FIG. 1 is a block diagram of a semiconductor apparatus according to a first embodiment of the present invention.

Referring now to the drawings, wherein like reference numerals designate identical or corresponding parts throughout the several views, embodiments of the present invention are described. FIG. 1 is a block diagram of a semiconductor apparatus 1 according to a first embodiment of the present invention. The semiconductor apparatus 1 includes a power supply circuit 2, a determination circuit 3, and various terminals. The terminals include a power supply input terminal IN, a voltage setting signal (clock) input terminal SETi, an output terminal OUT, and a ground terminal GND. The power supply input terminal IN receives an input voltage Vin. The voltage setting signal input terminal SETi receives a voltage setting signal Vset, which is a clock signal. Ground GND is connected to ground potential.

The power supply circuit 2 produces an output voltage Vout in accordance with the duty cycle of the voltage setting signal Vset, and outputs the output voltage Vout via the output terminal OUT. The determination circuit 3 determines whether a period of the voltage setting signal Vset at a low level or a high level exceeds a first predetermined time. If the determination circuit 3 determines that the period is less than the first predetermined time, it outputs a high-level enable signal EN, thereby activating the power supply circuit 2. If it determines that the period of the voltage setting signal Vset at either the low level or the high level is equal to or more than the first predetermined time, the determination circuit 3 outputs a low-level enable signal EN, which functions as a disable signal, thereby terminating the operation of the power supply circuit 2.

Figure 2:
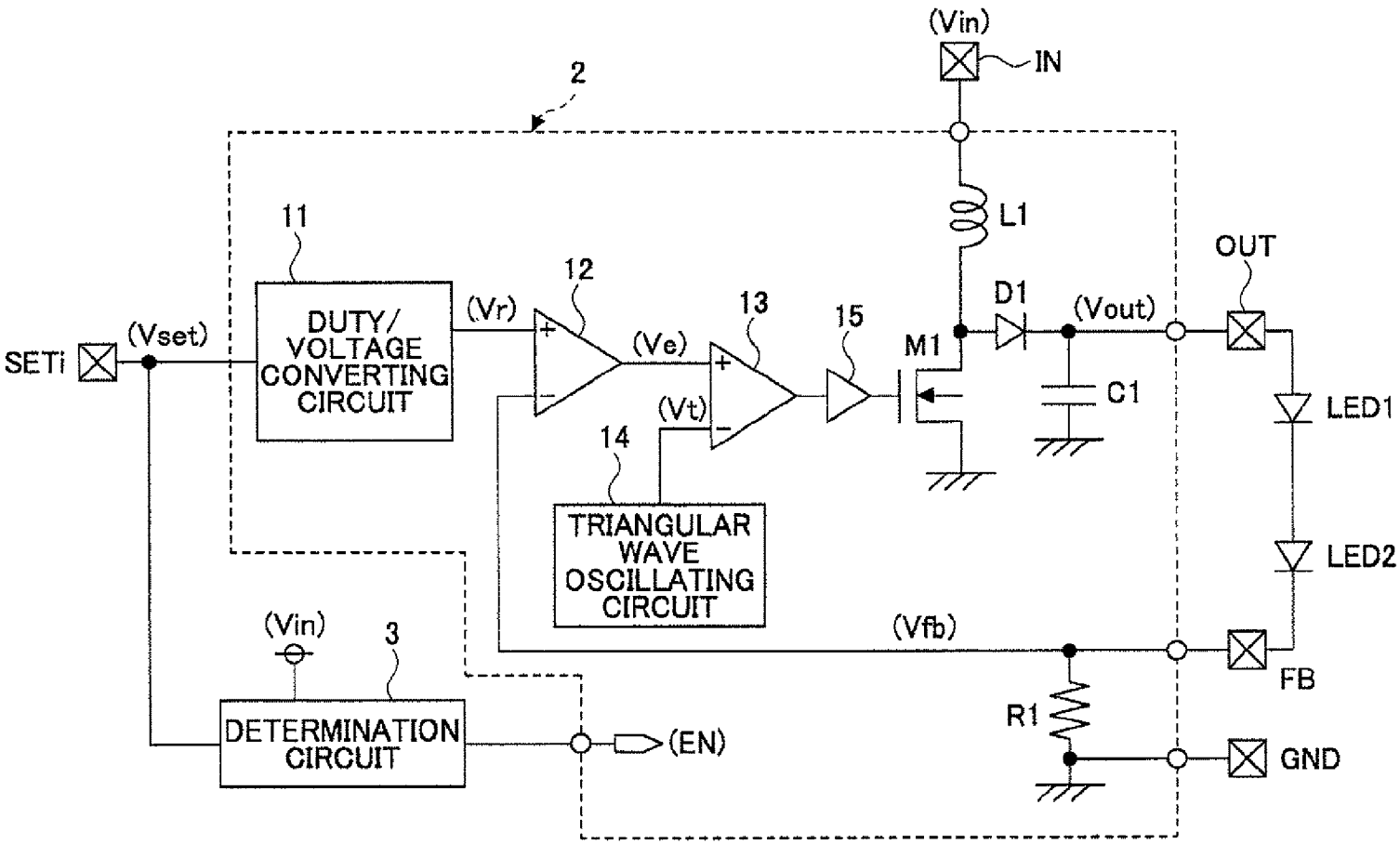
FIG. 2 is a diagram of an example of a power supply circuit in the semiconductor apparatus of FIG. 1.

FIG. 2 is a circuit diagram of an example of the power supply circuit 2. In this example, the power supply circuit 2 supplies power to LEDs 1 and 2, where the semiconductor apparatus 1 of FIG. 1 includes a feedback terminal FB. The power supply circuit 2 forms a step-up switching regulator of the asynchronous rectification type configured to step up the input voltage Vin applied to the power supply input terminal IN to a predetermined voltage that is obtained at the output terminal OUT as the output voltage Vout. The power supply circuit 2 includes a duty/voltage converting circuit 11; an error amplifying circuit 12; a PWM comparator 13; a triangular wave oscillating circuit 14 for generating a predetermined triangular wave voltage Vt; a buffer circuit 15; a switching transistor M1; an inductor L1; a diode D1 as a rectifier element; an output capacitor C1; and a resistor R1. The error amplifying circuit 12, the PWM comparator 13, the triangular wave oscillating circuit 14, the buffer circuit 15, and the resistor R1 form a control circuit unit.

The input end of the duty/voltage converting circuit 11 is connected to the voltage setting signal input terminal SETi. The output end of the duty/voltage converting circuit 11 is connected to a non-inverting input end of the error amplifying circuit 12. An inverting input end of the error amplifying circuit 12 is connected to the feedback terminal FB so that a feedback voltage Vfb is applied to the inverting input end of the error amplifying circuit 12. The resistor R1 is connected between the feedback terminal FB and ground GND. The output end of the error amplifying circuit 12 is connected to a non-inverting input end of the PWM comparator 13. An inverting input end of the PWM comparator 13 receives the triangular wave voltage Vt from the triangular wave oscillating circuit 14. The output end of the PWM comparator 13 is connected to the gate of the switching transistor M1 via the buffer circuit 15.

The source of the switching transistor M1 is connected to ground GND. The inductor L1 is connected between the input voltage Vin and the drain of the switching transistor M1. The anode of the diode D1 is connected to the drain of the switching transistor M1. The cathode of the diode D1 is connected to the output terminal OUT. Between the output terminal OUT and ground GND, the output capacitor C1 is connected. Between the output terminal OUT and the feedback terminal FB, the LEDs 1 and 2 are connected in series.

Figure 3:
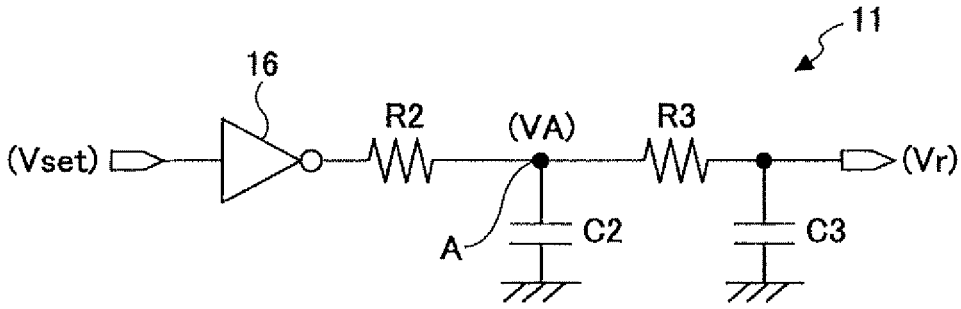
FIG. 3 is a diagram of an internal circuit structure of a duty/voltage converting circuit in the power supply circuit of FIG. 2.

The duty/voltage converting circuit 11 converts the duty cycle of the input voltage setting signal Vset into a voltage and outputs it as a reference voltage Vr. FIG. 3 illustrates an example of the internal circuit structure of the duty/voltage converting circuit 11. The example includes an inverter circuit 16, resistors R2 and R3, and capacitors C2 and C3. The input end of the inverter circuit 16 receives a voltage setting signal Vset. The output end of the inverter circuit 16 is connected to one end of the resistor R2. The other end of the resistor R2 is connected to one end of the capacitor C2 and one end of the resistor R3. The other end of the capacitor C2 is connected to ground GND. The capacitor C3 is connected between the other end of the resistor R3 and ground GND. The connecting portion of the resistor R3 and the capacitor C3 is continuous with the output end of the duty/voltage converting circuit 11, at which the reference voltage Vr is obtained.

The combination of the resistor R2 and the capacitor C2 and the combination of the resistor R3 and the capacitor C3 each form a low-pass filter. Thus, the output signal of the inverter circuit 16 is fed to the two stages of low-pass filters connected in series to generate the reference voltage Vr at the output.

Figure 4:
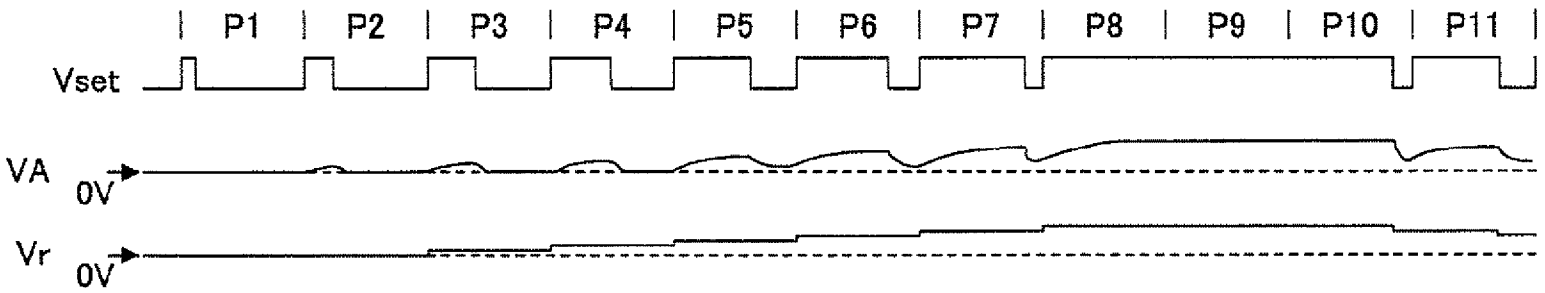
FIG. 4 is a timing chart of an operation of the duty/voltage converting circuit of FIG. 3.

FIG. 4 is a timing chart illustrating an operation of the duty/voltage converting circuit 11 depicted in FIG. 3. "VA" in FIG. 4 indicates a voltage waveform at a connecting portion A of the resistor R2, the capacitor C2, and the resistor R3 of FIG. 3. The connecting portion A is an output end of the first-stage low-pass filter. As seen from FIG. 4, the reference voltage Vr increases as the time durations in which the voltage setting signal Vset is at the high level increase, as indicated by periods P1 through P8 of Vset. In period P8, the duty cycle of the high level becomes 100% and the reference voltage Vr has a maximum value. In period P10, the duty cycle of the voltage setting signal Vset at the high level becomes less than 100% and the reference voltage Vr decreases. The circuit depicted in FIG. 3 is merely an example; the duty/voltage converting circuit 11 may be provided by any circuit capable of converting the duty cycle of the voltage setting signal Vset as a clock signal into a voltage.

Referring back to FIG. 2, the reference voltage Vr from the duty/voltage converting circuit 11 is applied to the non-inverting input end of the error amplifying circuit 12, to the inverting input end of which the feedback voltage Vfb is applied. The feedback voltage Vfb is obtained by converting a current supplied to the LEDs 1 and 2, which are connected across external terminals of the semiconductor apparatus 1, into a voltage using the resistor R1. The error amplifying circuit 12 amplifies a differential voltage between the reference voltage Vr and the feedback voltage Vfb to produce an error voltage Ve, which is applied to the non-inverting input end of the PWM comparator 13.

The inverting input end of the PWM comparator 13 receives the triangular wave voltage Vt from the triangular wave oscillating circuit 14. The PWM comparator 13 outputs a high level signal in a period in which the triangular wave voltage Vt is lower than the error voltage Ve. The high-level signal is applied via the buffer circuit 15 to the gate of the switching transistor M1, thereby turning on the switching transistor M1. In response, a current flows from the power supply input terminal IN via the inductor L1 and the switching transistor M1 to ground GND, whereby energy is stored in the inductor L1.

When the triangular wave voltage Vt is equal to or higher than the error voltage Ve, the PWM comparator 13 outputs a low level signal, so that the switching transistor M1 turns off. As a result, the current supply to the inductor L1 is blocked, and a back electromotive force is produced in the inductor L1. Consequently, the voltage at the connecting portion between the inductor L1 and the drain of the switching transistor M1 becomes higher than the input voltage Vin. The output capacitor C1 is charged by the higher voltage at the connecting portion via the diode D1, and the output voltage Vout is stepped up to a voltage higher than the input voltage Vin.

Thus, because the power supply circuit 2 controls the output voltage Vout such that the feedback voltage Vfb is substantially equal to the reference voltage Vr, the current supplied to the LEDs 1 and 2 can be changed by varying the reference voltage Vr. Thus, the illuminance of the LEDs 1 and 2 can be adjusted by the reference voltage Vr. Although not shown in FIG. 2, the enable signal EN is applied to the error amplifying circuit 12, the triangular wave oscillating circuit 14, and the PWM comparator 13. Thus, when the enable signal EN assumes the low level, the error amplifying circuit 12, the triangular wave oscillating circuit 14, and the PWM comparator 13 cease operation, whereby the power supply circuit 2 is disabled and its current output to the output terminal OUT is terminated.

Figure 5:
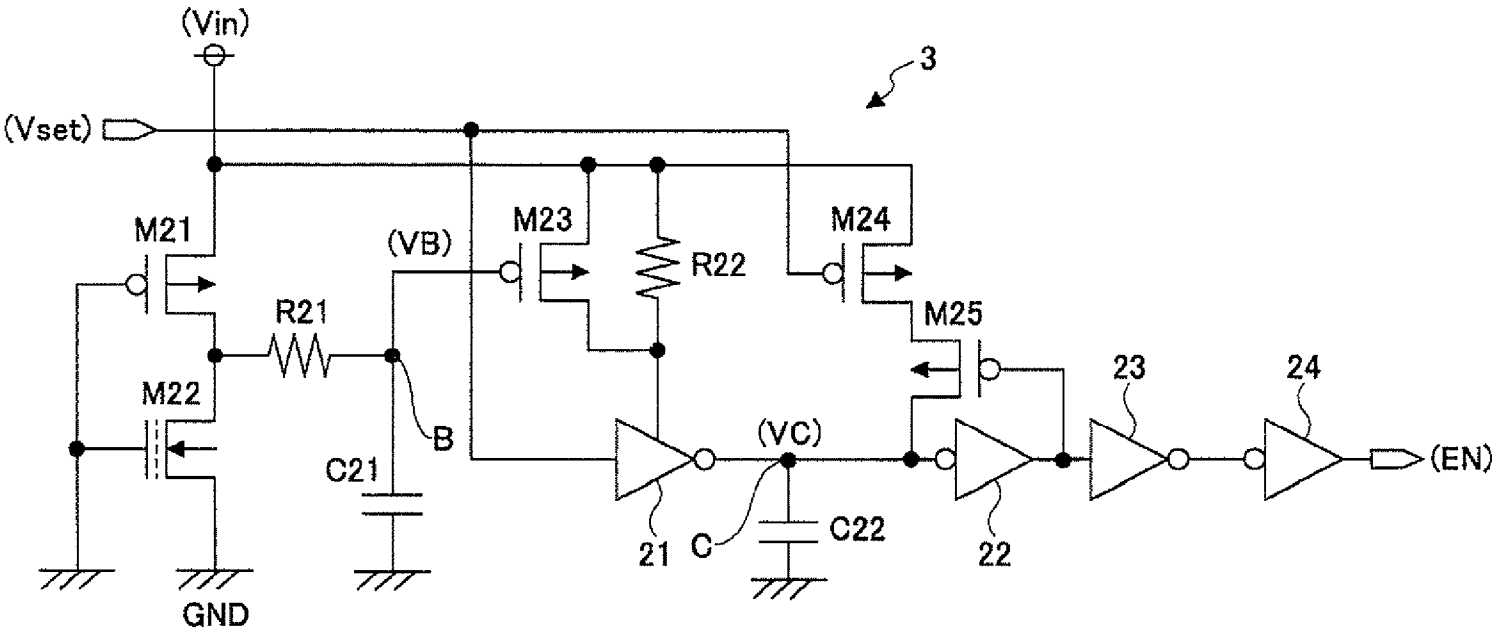
FIG. 5 is a diagram of an example of a determination circuit in the semiconductor apparatus of FIG. 1.

FIG. 5 illustrates an example of the determination circuit 3. In this example, the determination circuit 3 includes PMOS transistors M21 and M23 through M25; a depletion-type NMOS transistor M22; inverter circuits 21 through 24; resistors R21 and R22; and capacitors C21 and C22. The capacitor C21 may be referred to as a first capacitor. The PMOS transistor M21, the depletion-type NMOS transistor M22, and the resistor R21 form a first charge/discharge circuit. The capacitor C22 may be referred to as a second capacitor. The PMOS transistor M23, the resistor R22, and the inverter circuit 21 form a second charge/discharge circuit. The inverters 22 through 24 form a binarizing circuit. The PMOS transistors M24 and M25 form a retaining circuit.

The source of the PMOS transistor M21 is connected to the input voltage Vin. The depletion-type NMOS transistor M22 is connected between the drain of the PMOS transistor M21 and ground GND. The gate of the PMOS transistor M21 is connected to the gate of the depletion-type NMOS transistor M22, and the connecting portion of the gates is connected to ground GND. The resistor R21 is connected between the drain of the PMOS transistor M21 and the gate of the PMOS transistor M23. The capacitor C21 is connected between the gate of the PMOS transistor M23 and ground GND.

The PMOS transistor M23 and the resistor R22 are connected in parallel between the input voltage Vin and a positive power supply input end of the inverter circuit 21. The input end of the inverter circuit 21 receives the voltage setting signal Vset. The capacitor C22 is connected between the output end of the inverter circuit 21 and ground GND. The output end of the inverter circuit 21 is connected to the input end of the inverter circuit 22. Between the input voltage Vin and the input end of the inverter circuit 22, the PMOS transistors M24 and M25 are connected in series. The gate of the PMOS transistor M24 receives the voltage setting signal Vset. The gate of the PMOS transistor M25 is connected to the output end of the inverter circuit 22. The output end of the inverter circuit 22 is connected to the input end of the inverter circuit 23. The output end of the inverter circuit 23 is connected to the input end of the inverter circuit 24. The output end of the inverter circuit 24 constitutes the output end of the determination circuit 3, where the enable signal EN is obtained.

Figure 6:
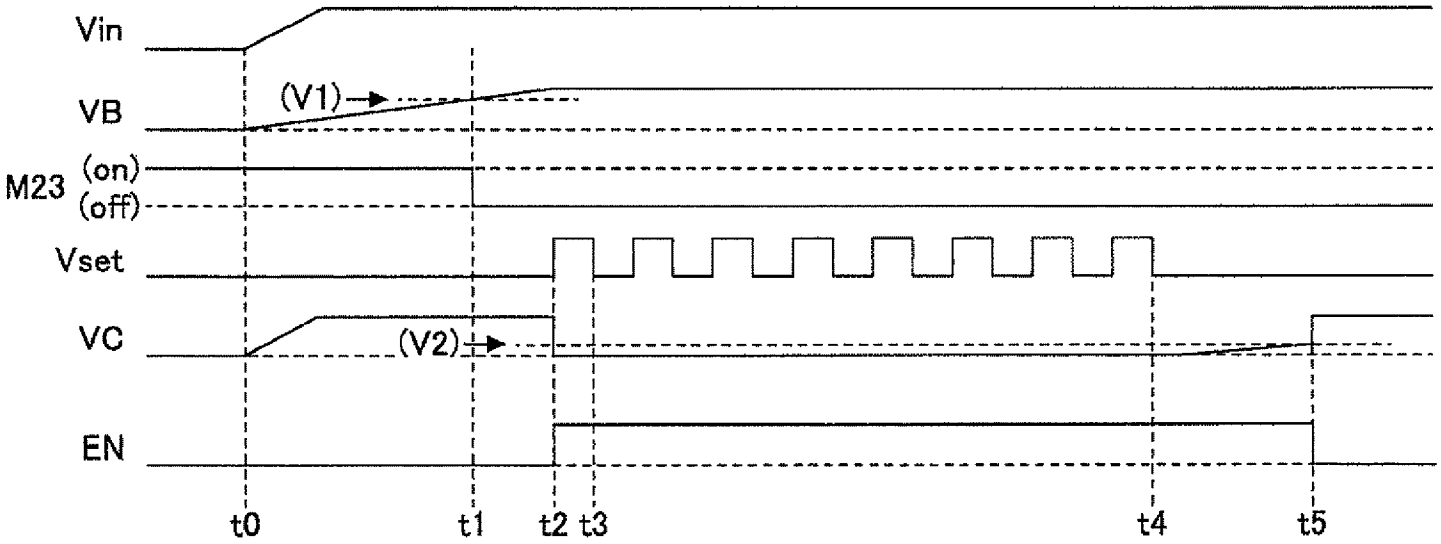
FIG. 6 is a timing chart of an operation of the determination circuit of FIG. 5.

FIG. 6 is a timing chart of an operation of the determination circuit 3. "VB" in FIG. 6 indicates a voltage at a connecting portion B where the gate of the PMOS transistor M23, the resistor R21, and the capacitor C21 are connected, as depicted in FIG. 5. "VC" indicates a voltage at a connecting portion C where the output end of the inverter circuit 21, the input end of the inverter circuit 22, the PMOS transistor M25, and the capacitor C22 are connected, as depicted in FIG. 5.

Referring to the timing chart of FIG. 6, the input voltage Vin is applied to the power supply input terminal IN at time t0, whereby the PMOS transistor M21, whose gate is grounded, immediately turns on. Then, current flows via the PMOS transistor M21 to the depletion-type NMOS transistor M22, which is zero-biased, and the resistor R21. The current supplied to the resistor R21 charges the capacitor C21, so that the voltage VB at the connecting portion B gradually increases. Because the PMOS transistor M23 is on until the voltage VB reaches a threshold voltage V1 of the PMOS transistor M23, the input voltage Vin is applied to the inverter circuit 21 as a power supply voltage, via the PMOS transistor M23.

The voltage setting signal Vset remains at the low level for a while following the input of the input voltage Vin, as depicted in FIG. 6. Thus, the inverter circuit 21 outputs a high-level signal, and the capacitor C22 is charged by this high-level output voltage. At this time, the PMOS transistor M23 that supplies power to the inverter circuit 21 is on, so that the capacitor C22 is charged quickly, and the voltage VC at the connecting portion C increases, substantially equaling the input voltage Vin.

Because the input voltage to the inverter circuit 22 is the voltage VC at the connecting portion C, a high level signal is applied to the input end of the inverter circuit 22. Thus, the inverter circuit 22 outputs a low level signal, which is applied to the gate of the PMOS transistor M25. As a result, the PMOS transistor M25 turns on. Because the gate of the PMOS transistor M24 is supplied with the voltage setting signal Vset, the PMOS transistor M24 is also on. Thus, the connecting portion C is connected to the input voltage Vin via the PMOS transistors M24 and M25. As a result, the connecting portion C has the high level simultaneously with the input of the input voltage Vin due to the output signal of the inverter circuit 21 and the PMOS transistors M24 and M25.

The inverter circuit 22 outputs a low level signal as mentioned above, so that the inverter circuit 23 outputs a high level signal and the inverter circuit 24 outputs a low level signal. Thus, the enable signal EN as the output signal of the determination circuit 3 is at the low level. The low-level enable signal EN acts as a disable signal and as such disables the power supply circuit 2. In other words, immediately after the input of the input voltage Vin, the determination circuit 3 outputs a disable signal and the power supply circuit 2 does not operate. Then, at time t1, the voltage VB at the connecting portion B exceeds the threshold voltage V1 of the PMOS transistor M23 to turn off the PMOS transistor M23. Consequently, only the resistor R22 is connected between the power supply input end of the inverter circuit 21 and the power supply input terminal IN.

At time t2, the voltage setting signal Vset assumes the high level and the PMOS transistor M24 turns off, thereby terminating the connection between the connecting portion C and the input voltage Vin. Further, the inverter circuit 21 outputs a low level signal via the output end of the inverter circuit 21, so that the capacitor C22 is quickly discharged, resulting in the connecting portion C having the low level. The low level signal is output via the inverter circuits 22 through 24, and therefore the enable signal EN as the output signal of the determination circuit 3 assumes the high level. As a result, the power supply circuit 2 starts operating. In this case, the PMOS transistor M25 is turned off because the inverter circuit 22 outputs a high level signal.

At time t3, the voltage setting signal Vset returns to the low level, and the output signal of the inverter circuit 21 tends to reach the high level. However, the rate of increase of the voltage VC is extremely low because the PMOS transistor M23 is off and the capacitor C22 is charged through the resistor R22. At this time, although the PMOS transistor M24 turns on, the output signal of the inverter circuit 22 remains at the high level. Thus, the PMOS transistor M25 is off so that it does not provide connection between the input voltage Vin and the connecting portion C. As a result, the voltage VC does not reach the input threshold voltage V2 of the inverter circuit 22 before the voltage setting signal Vset next assumes the high level, and therefore the enable signal EN remains at the high level. Thereafter, the high-level enable signal EN is continuously output as long as the voltage setting signal Vset repeats between the high and low levels or remains at the high level.

Next, at time t4, as the voltage setting signal Vset assumes the low level and remains at the low level, the voltage VC begins to increase. At time t5, the voltage VC exceeds the input threshold voltage V2 of the inverter circuit 22, and the output signal of the inverter circuit 22 is inverted to the low level. Then, the enable signal EN returns to the low level and becomes a disable signal, terminating the operation of the power supply circuit 2. Further, the PMOS transistor M25 turns on. The PMOS transistor M24 had already turned on when the voltage setting signal Vset assumed the low level. Thus, both the PMOS transistors M24 and M25 are on to connect the connecting portion C to the input voltage Vin and the voltage VC immediately rises to the input voltage Vin.

The status after time t5 is the same as that between time t1 and time t2. Namely, when the voltage setting signal Vset assumes the high level again, the same operation as described above with reference to time t2 is performed, whereby the enable signal EN is output and the power supply circuit 2 is activated. The depletion-type NMOS transistor M22 functions to quickly discharge the capacitor C21 through the resistor R21 upon termination of application of the input voltage Vin.

In the foregoing description, the output voltage Vout is varied depending on the duty cycle of the high level of the voltage setting signal Vset. Alternatively, the output voltage Vout may be varied depending on the duty cycle of the low level of the voltage setting signal Vset. In this case, the operation of the power supply circuit 2 may be terminated by the enable signal EN that is output when the voltage setting signal Vset has the high level for a predetermined time.

Figure 7:
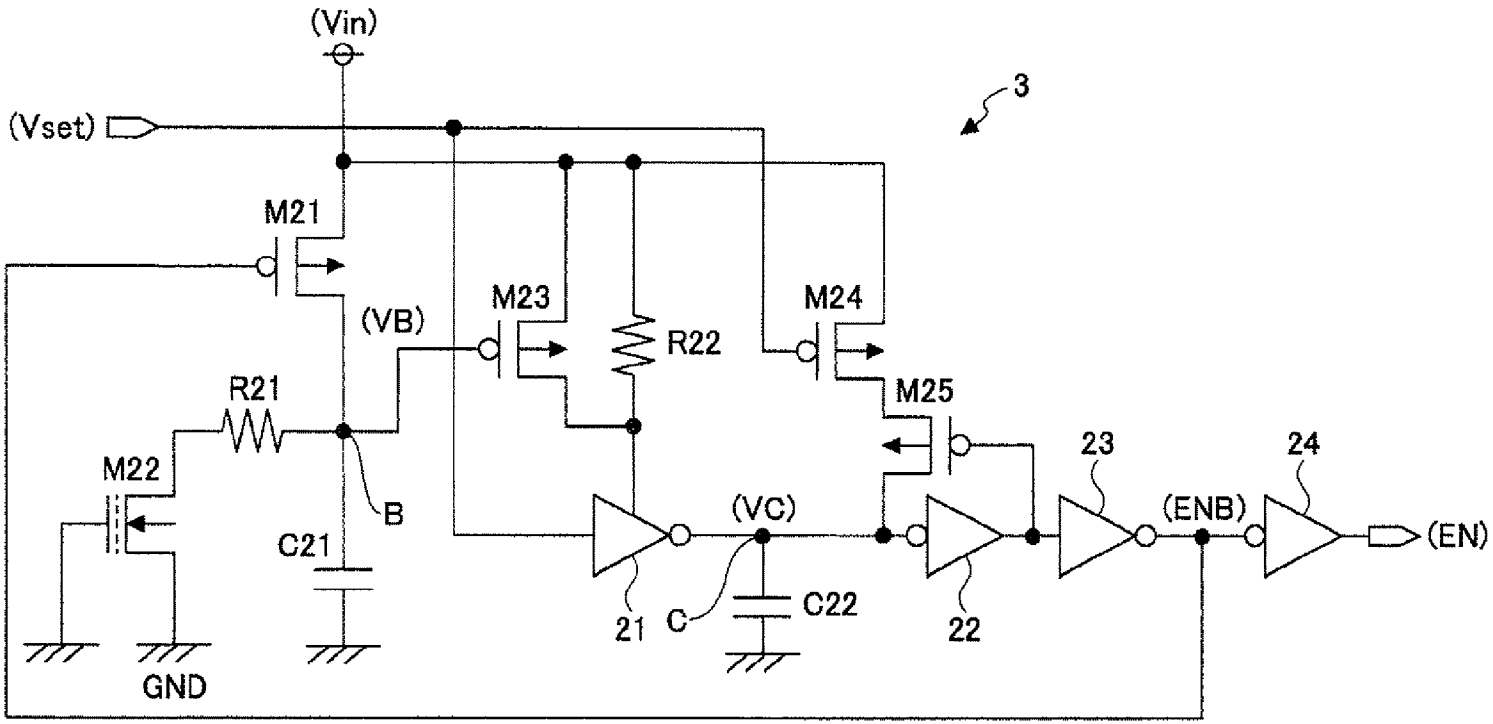
FIG. 7 is a diagram of another example of the determination circuit in the semiconductor apparatus of FIG. 1.

It has also been described with reference to FIG. 5 that the capacitor C21 is charged when it is connected via the PMOS transistor M21 and the resistor R21 to the input voltage Vin. Alternatively, the capacitor C21 may be charged only through the PMOS transistor M21, as depicted in FIG. 7. In FIG. 7, similar elements to those of FIG. 5 are designated with similar reference numerals or signs and their description is omitted. The circuit structure of FIG. 7 differs from that of FIG. 5 in that the PMOS transistor M21 is connected between the input voltage Vin and the connecting portion B, and the gate of the PMOS transistor M21 is supplied with the output signal of the inverter circuit 23, i.e., a signal ENB which is the enable signal EN with an inverted signal level.

Referring to FIG. 7, when the input voltage Vin is not applied to the power supply input terminal IN, the capacitor C21 is discharged and the connecting portion B is at the low level. Upon application of the input voltage Vin, the PMOS transistor M23 immediately turns on, and the output signal of the inverter circuit 21 immediately rises to the high level because the voltage setting signal Vset is at the low level upon application of the input voltage Vin, as in the case of FIG. 5. Then, the signal ENB has the high level and the enable signal EN has the low level, whereby the operation of the power supply circuit 2 is terminated.

When the voltage setting signal Vset has the high level, the capacitor C22 is quickly discharged, so that the voltage VC at the connecting portion C quickly decreases to the low level. As a result, the signal ENB has the low level and the PMOS transistor M21 turns on. The capacitor C21 is then quickly charged and the connecting portion B has the high level, so that the PMOS transistor M23 turns off. Because the enable signal EN has the high level, the power supply circuit 2 starts operating.

When the voltage setting signal Vset has the low level, because the PMOS transistor M23 is off, the inverter circuit 21 is supplied with power via the resistor R22, and the charge time of the capacitor C22 is extended. Unless the connecting portion C has the high level within the period in which the voltage setting signal Vset has the low level, the signal ENB maintains the low level and the enable signal EN maintains the high level, so that the power supply circuit 2 keeps operating.

In the circuit of FIG. 7, when the enable signal EN is at the low level and the operation of the power supply circuit 2 is stopped, the signal ENB has the high level and the PMOS transistor M21 is turned off. Thus, the current that keeps flowing through the PMOS transistor M21 and the depletion-type NMOS transistor M22 in the case of FIG. 5 can be terminated in the circuit of FIG. 7. Thus, current consumption during a standby period can be reduced.

Thus, in accordance with the first embodiment of the present invention, the determination circuit 3 of the semiconductor apparatus determines whether the voltage setting signal Vset is applied. If it determines the presence of the voltage setting signal Vset, the determination circuit 3 outputs a high-level enable signal EN to activate the power supply circuit 2. On the other hand, if it determines that the voltage setting signal Vset is not present, the determination circuit 3 outputs a low-level enable signal EN to disable the operation of the power supply circuit 2. In this way, the need for providing a separate external terminal to the semiconductor apparatus for the input of the enable signal can be eliminated, thus reducing the number of terminals of the semiconductor apparatus.

The determination circuit 3 outputs a disable signal to the power supply circuit 2 in a second predetermined time between time t0 immediately after the input of the input voltage Vin and time t1. Therefore, activation of the power supply circuit 2 before the output of the voltage setting signal Vset can be prevented, thereby preventing the output of an erroneous output voltage Vout. Furthermore, up to 100% of the duty cycle of the voltage setting signal Vset can be utilized.

In the foregoing description of the first embodiment, the power supply circuit 2 has been described as being a step-up switching regulator of the asynchronous rectification type. However, this is merely an example; alternatively, the power supply circuit 2 may be a step-up switching regulator of the synchronous rectification type. In this case, the diode D1 may be replaced with a PMOS transistor for synchronous rectification, and the gate of the synchronous rectification transistor may be supplied with a gate signal of the switching transistor M1 having an inverted signal level, so that the synchronous rectification transistor performs an opposite switching operation to the switching transistor M1.

In an embodiment, the power supply circuit 2 may be a step-down switching regulator or an inverting switching regulator, rather than a step-up switching regulator as in the first embodiment. In another embodiment, the power supply circuit 2 may include a linear regulator, such as a series regulator. In this case, the power supply circuit 2 may include an output transistor for controlling the output voltage Vout by performing an operation in accordance with a control signal applied to a control electrode, wherein the error amplifying circuit 12 is configured to amplify a voltage difference between the reference voltage Vr from the duty/voltage converting circuit 11 and the feedback voltage Vfb that is in proportion to the output voltage Vout. Based on the error voltage Ve produced by the error amplifying circuit 12, the current output of the output transistor may be controlled so that the output voltage Vout remains at a predetermined voltage.

Although this invention has been described in detail with reference to certain embodiments, variations and modifications exist within the scope and spirit of the invention as described and defined in the following claims.

The present application is based on the Japanese Priority Application No. 2009-064448 filed Mar. 17, 2009, the entire contents of which are hereby incorporated by reference.

The invention claimed is:

1. A semiconductor apparatus comprising:

an input terminal to which an input voltage is applied;

an output terminal at which an output voltage is obtained;

a power supply circuit unit configured to generate the output voltage from the input voltage, the output voltage having a value corresponding to a duty cycle of a voltage setting signal that is externally applied to the semiconductor apparatus; and a determination circuit unit configured to determine whether the voltage setting signal has a predetermined signal level for the duration of a first predetermined time, wherein the determination circuit unit, when it determines that the voltage setting signal does not have the predetermined signal level for the duration of the first predetermined time, activates the power supply circuit unit, and deactivates the power supply circuit unit when it determines that the voltage setting signal has the predetermined signal level for the duration of the first predetermined time, wherein the determination circuit unit includes:

a first capacitor;

a first charge/discharge circuit configured to charge the first capacitor with the input voltage applied to the input terminal, and configured to discharge the first capacitor when the input voltage is not applied to the input terminal;

a second capacitor;

a second charge/discharge circuit configured to charge or discharge the second capacitor in accordance with a signal level of the voltage setting, and configured to change the rate of charging of the second capacitor depending on a terminal voltage of the first capacitor;

a binarizing circuit configured to generate a signal for controlling the activation of the power supply circuit unit by binarizing a terminal voltage of the second capacitor; and a retaining circuit configured to retain a signal level of an output signal of the binarizing circuit upon inversion of the signal level of the output signal of the binarizing circuit as a result of the discharge of the second capacitor, the retaining circuit retaining the signal level of the output signal of the binarizing circuit by charging the second capacitor with the input voltage in accordance with the signal level of the voltage setting signal, wherein the second charge/discharge circuit is configured to decrease the rate of charging of the second capacitor when the terminal voltage of the first capacitor exceeds a predetermined value.

2. The semiconductor apparatus according to claim 1, wherein the determination circuit unit deactivates the power supply circuit unit during a second predetermined time following the start of application of the input voltage to the input terminal.

3. The semiconductor apparatus according to claim 1, wherein the power supply circuit unit includes:

an output transistor configured to control the output voltage in accordance with a control signal applied to a control electrode of the output transistor;

a duty/voltage converting circuit unit configured to generate a reference voltage by converting the duty cycle of the voltage setting signal into a voltage; and a control circuit unit configured to control the output transistor so that a feedback voltage which is proportional to the output voltage at the output terminal becomes equal to the reference voltage.

4. The semiconductor apparatus according to claim 3, wherein the output transistor performs a switching operation in accordance with the control signal applied to the control electrode, wherein the power supply circuit unit includes an inductor that is charged with the input voltage by the switching operation of the output transistor, and a rectifier element configured to discharge the inductor when the output transistor is turned off, wherein the control circuit unit includes a switching regulator configured to control the switching operation of the output transistor so that the feedback voltage becomes equal to the reference voltage.

5. The semiconductor apparatus according to claim 3, wherein the duty/voltage converting circuit unit includes a low-pass filter to which the voltage setting signal is applied.

6. The semiconductor apparatus according to claim 1, wherein the output voltage is applied to a light-emitting diode via the output terminal.

7. The semiconductor apparatus according to claim 6, wherein the power supply circuit unit is configured to adjust the illuminance of the light-emitting diode depending on the duty cycle of the voltage setting signal.

8. A method of controlling an operation of a semiconductor apparatus, the method comprising:

generating an output voltage at an output terminal of the semiconductor apparatus from an input voltage applied to an input terminal of the semiconductor apparatus, the output voltage having a value corresponding to a duty cycle of a voltage setting signal externally applied to the semiconductor apparatus;

determining whether the voltage setting signal has a predetermined signal level for the duration of a first predetermined time;

supplying the output voltage to the output terminal of the semiconductor apparatus when the determining step determines that the voltage setting signal does not have the predetermined signal level for the duration of the first predetermined time;

not supplying the output voltage to the output terminal when the determining step determines that the voltage setting signal has the predetermined signal level for the duration of the first predetermined time; and not supplying the output voltage to the output terminal during a second predetermined time following the start of application of the input voltage to the input terminal.

9. The method of controlling an operation of a semiconductor apparatus according to claim 8, further comprising applying the output voltage to a light-emitting diode via the output terminal, wherein the illuminance of the light-emitting diode is adjusted depending on the duty cycle of the voltage setting signal.

10. The semiconductor apparatus according to claim 2, wherein the power supply circuit unit includes:

an output transistor configured to control the output voltage in accordance with a control signal applied to a control electrode of the output transistor;

a duty/voltage converting circuit unit configured to generate a reference voltage by converting the duty cycle of the voltage setting signal into a voltage; and a control circuit unit configured to control the output transistor so that a feedback voltage which is proportional to the output voltage at the output terminal becomes equal to the reference voltage.

11. The semiconductor apparatus according to claim 2, wherein the output voltage is applied to a light-emitting diode via the output terminal.

* * * * *